US007722399B2

(12) United States Patent
Scherer et al.

(10) Patent No.: US 7,722,399 B2
(45) Date of Patent: May 25, 2010

(54) CONNECTOR APPARATUS

(75) Inventors: Richard J. Scherer, Austin, TX (US); Kevin R. Meredith, Cedar Park, TX (US); Johannes P. M. Kusters, Cedar Park, TX (US); Jerome P. Dattilo, Cedar Park, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 12/395,121

(22) Filed: Feb. 27, 2009

(65) Prior Publication Data

US 2009/0163078 A1 Jun. 25, 2009

Related U.S. Application Data

(62) Division of application No. 10/788,684, filed on Feb. 27, 2004, now Pat. No. 7,513,797.

(51) Int. Cl.
*H01R 13/648* (2006.01)

(52) U.S. Cl. ..... 439/607.05; 439/607.08; 439/607.1

(58) Field of Classification Search ..... 439/607.05, 439/607.07, 607.08, 607.1, 607.11, 607.12, 439/607.39
See application file for complete search history.

(56) References Cited

U.S. PATENT DOCUMENTS

| | | | |
|---|---|---|---|
| 3,936,466 | A | 2/1976 | Bodor et al. |
| 4,472,765 | A | 9/1984 | Hughes |
| 4,686,607 | A | 8/1987 | Johnson |
| 4,943,245 | A | 7/1990 | Lincoln |
| 4,964,814 | A | 10/1990 | Tengler et al. |
| 5,176,538 | A | 1/1993 | Hansell, III et al. |
| 5,441,424 | A | 8/1995 | Morlion et al. |
| 5,620,340 | A | 4/1997 | Andrews |
| 5,766,036 | A | 6/1998 | Ahmad et al. |
| 5,775,924 | A | 7/1998 | Miskin et al. |
| 5,775,947 | A | 7/1998 | Suzuki et al. |

(Continued)

FOREIGN PATENT DOCUMENTS

| | | |
|---|---|---|
| EP | 0 374 307 | 6/1990 |

(Continued)

OTHER PUBLICATIONS

"Z-Pack HS3 2.5 mm Connectors", AMP Catalog 1307767, Issued Nov. 1999. (pp. 197,201, and 203).

*Primary Examiner*—Xuong M Chung-Trans
(74) *Attorney, Agent, or Firm*—Melanie G. Gover

(57) ABSTRACT

A connector system including a header connector with a header body having an internal surface and an external surface. A plurality of first openings and a plurality of second openings extend from the internal surface to the external surface of the header body. A plurality of signal pins are inserted into the plurality of first openings to form an array of pin contacts extending from the internal surface of the header body. A plurality of shield blades are inserted into the plurality of second openings. Each of the plurality of shield blades has at a first end thereof a generally right angle shielding portion configured to be disposed adjacent to a corresponding signal pin. The first ends of the plurality of shield blades are substantially coplanar with the internal surface of the header body.

15 Claims, 8 Drawing Sheets

U.S. PATENT DOCUMENTS

| | | | | |
|---|---|---|---|---|
| 5,971,770 | A | 10/1999 | Richmond | |
| 6,123,550 | A | 9/2000 | Burkert et al. | |
| 6,146,157 | A * | 11/2000 | Lenoir et al. | 439/101 |
| 6,146,202 | A | 11/2000 | Ramey et al. | |
| 6,203,369 | B1 | 3/2001 | Feldman | |
| 6,435,913 | B1 * | 8/2002 | Billman | 439/607.1 |
| 6,471,548 | B2 * | 10/2002 | Bertoncini et al. | 439/607.1 |
| 6,478,624 | B2 | 11/2002 | Ramey et al. | |
| 6,527,587 | B1 * | 3/2003 | Ortega et al. | 439/607.05 |

FOREIGN PATENT DOCUMENTS

| | | | |
|---|---|---|---|
| EP | 0570181 | B1 | 11/1993 |
| EP | 1 049 201 | A1 | 11/2000 |
| WO | WO 01/06675 | A1 | 1/2001 |

* cited by examiner

CONNECTOR APPARATUS

CROSS-REFERENCE TO RELATED APPLICATIONS

This application is a divisional of U.S. Ser. No. 10/788,684, filed Feb. 27, 2004, now U.S. Pat. No. 7,513,797, the disclosure of which is incorporated by reference in its entirety herein.

BACKGROUND

This invention relates to electrical connectors, and particularly to high-speed electrical connectors for attachment to printed circuit boards.

Conductors carrying high frequency signals and currents are subject to interference and cross talk when placed in close proximity to other conductors carrying high frequency signals and currents. This interference and cross talk can result in signal degradation and errors in signal reception. Coaxial and shielded cables are available to carry signals from a transmission point to a reception point, and reduce the likelihood that the signal carried in one shielded or coaxial cable will interfere with the signal carried by another shielded or coaxial cable in close proximity. However, at points of connection, the shielding is often lost, thereby allowing interference and crosstalk between signals. The use of individual shielded wires and cables is not desirable at points of connections due to the need for making a large number of connections in a very small space. In these circumstances, two-part high-speed backplane electrical connectors containing multiple shielded conductive paths are used. Specification IEC 1076-4-101 from the International Electrotechnical Commission sets out parameters for 2 mm, two-part connectors for use with printed circuit boards.

As users modify and upgrade systems to achieve improved performance, problems related to backward compatibility arise between, for example, CompactPCI® or FutureBus® connectors and modern high-speed shielded connectors. This means that users wishing to upgrade their system performance by changing to a shielded connector system must upgrade both connector elements (header and socket components) and perhaps additionally change the overall packaging of their system. A connector system that provides an increase in performance, while still permitting backwards compatibility with, for example, CompactPCI® or FutureBus® connectors is desirable.

SUMMARY

One aspect of the invention described herein provides an electrical header connector. In one embodiment according to the invention, the header connector includes a header body having an internal surface and an external surface. The header body includes a plurality of first openings and a plurality of second openings extending from the internal surface to the external surface. A plurality of signal pins are configured for insertion into the plurality of first openings to form an array of pin contacts extending from the internal surface of the header body. A plurality of shield blades are configured for insertion into the plurality of second openings. Each of the plurality of shield blades has at a first end thereof a generally right angle shielding portion configured to be disposed adjacent to a corresponding one of the plurality of signal pins. The first ends of the plurality of shield blades are substantially coplanar with the internal surface of the header body.

Another aspect of the invention described herein provides a system for connection to a printed circuit board. In one embodiment according to the invention, the connector system includes a first header body and a second header body. The first and second header bodies have a front wall formed to include a plurality of first openings and a plurality of second openings therethrough. The first and second header bodies are positioned on opposite sides of a printed circuit board. A plurality of signal pins are configured for insertion in the plurality of first openings in the first and second header bodies. Each of the plurality of signal pins extends continuously through the first openings of the first and second header bodies and the printed circuit board. A first plurality of shield blades is configured for insertion in the plurality of second openings in the first header body, and a second plurality of shield blades configured for insertion in the plurality of second openings in the second header body. Each shield blade of the first plurality of shield blades has a first end that is substantially coplanar with an internal surface of the first front wall.

Another aspect of the invention described herein provides a connector system. In one embodiment according to the invention, the connector system includes a header connector and a socket connector configured to mate with the header connector. The header connector has a front wall with an internal surface. The front wall includes a plurality of first openings and a plurality of second openings extending therethrough. A plurality of signal pins are inserted in the plurality of first openings to form an array of pin contacts extending above the internal surface of the header body. A plurality of shield blades are inserted in the plurality of second openings. Each of the plurality of shield blades has a first end that is substantially coplanar with the internal surface of the header body.

DETAILED DESCRIPTION

In the following detailed description of the preferred embodiments, reference is made to the accompanying drawings, which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
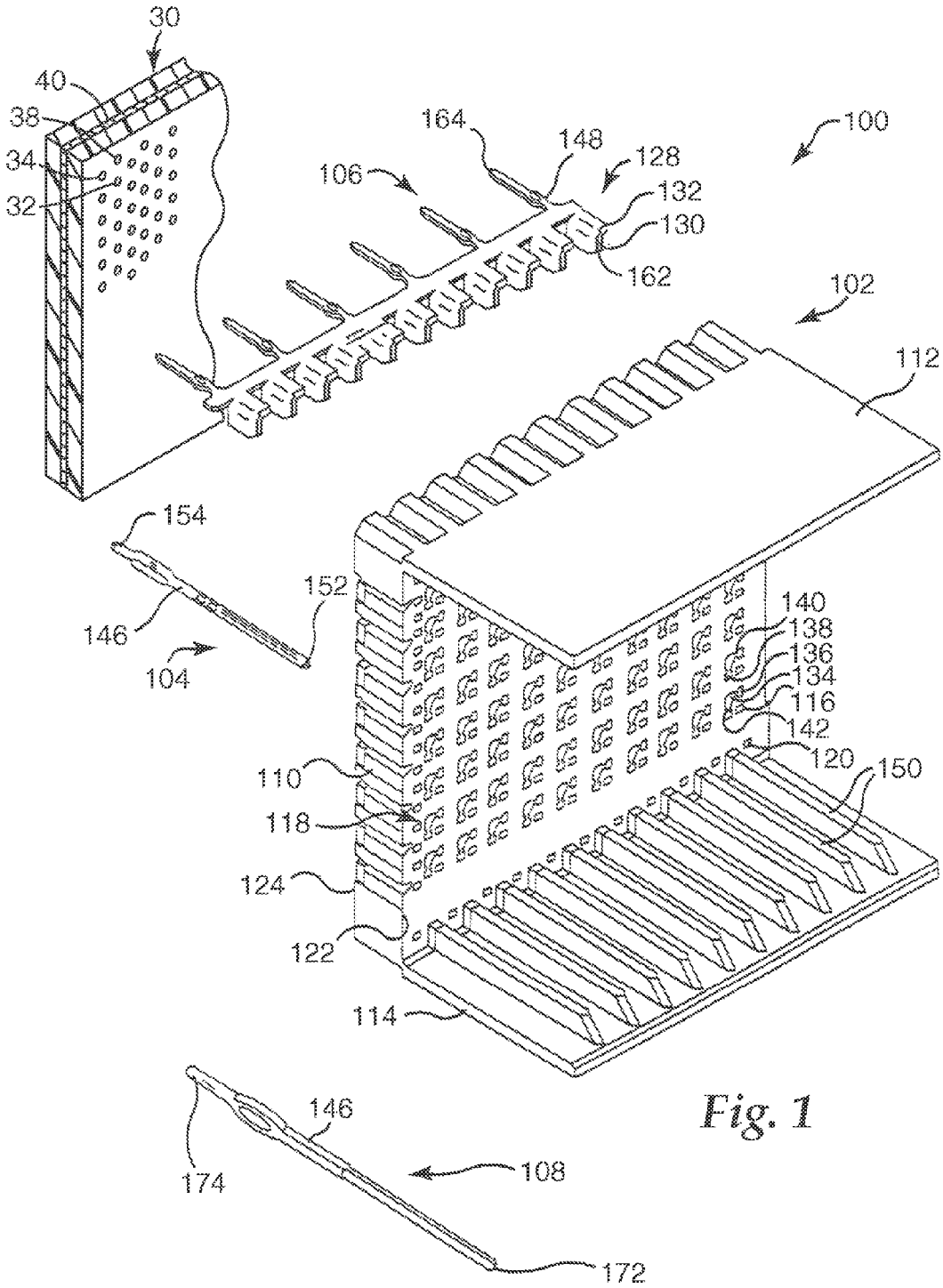
FIG. 1 is an exploded perspective view of a header connector in accordance with the invention having an array of male pin contacts and shield blades.
Figure 2:
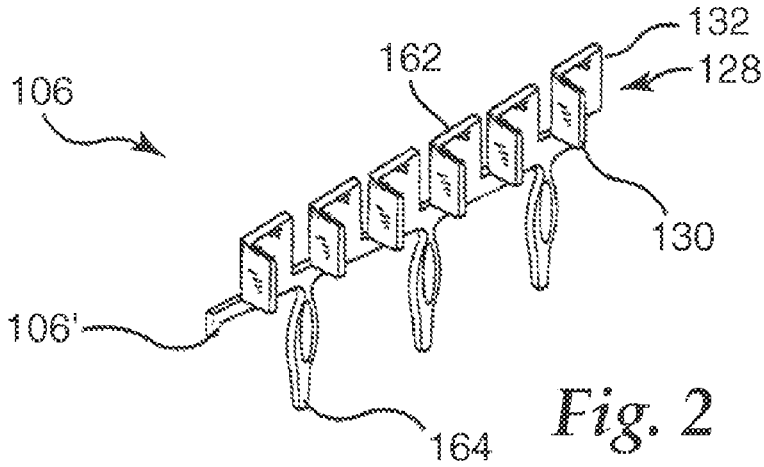
FIG. 2 is a perspective view of the continuous strip of shield blades of FIG. 1.
Figure 3:
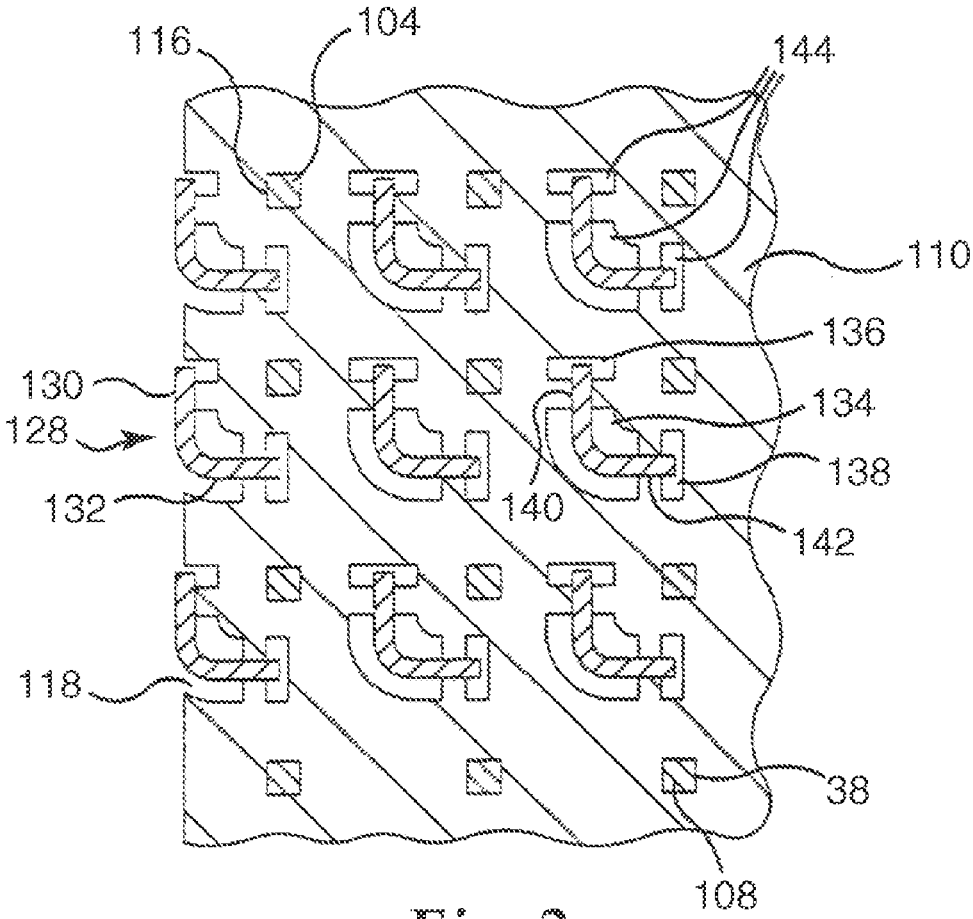
FIG. 3 is a cross-sectional view of the front wall of the header connector showing signal pins surrounded by right angle portions of the shield blades forming coaxial shields around each signal pin.

FIGS. 1, 2, and 3 show a header connector 100 in accordance with the present invention. The header connector 100 is configured for attachment to a printed circuit board 30 and connection to a mating socket connector 200 (shown in FIG. 5). The header connector 100 includes a header body 102, a plurality of signal pins 104, a continuous strip of material having a plurality of shield blades 106 formed therein, and a plurality of ground pins 108. Except for their length, the ground pins 108 are substantially identical to the signal pins 104. The header body 102 is formed to include a vertical front wall 110, and top and bottom laterally-extending, horizontal walls 112 and 114 projecting perpendicularly therefrom. The front wall 110 is formed to include a plurality of first signal-pin-receiving openings 116, a plurality of second shield-blade-receiving openings 118, and a plurality of third ground-pin-receiving openings 120, all of which extend between an internal surface 122 and an external surface 124 of front wall 110. The plurality of second shield-blade-receiving openings 118 are formed to have a generally right angle cross-section. The openings 116, 118, 120 may include chamfered entrances at one or both of internal surface 122 and external surface 124 to assist in the insertion of pins 104, 108 and shield blades 106.

The plurality of signal pins 104 are configured for insertion into the plurality of first signal-pin-receiving openings 116 in the header connector 100 to form an array of signal pins 104 which are configured for reception in an array of pin-insertion windows 230 in mating socket connector 200 (shown in FIG. 5), when the socket connector 200 is inserted into the header connector 100. Each signal pin 104 includes a first end 152 extending above the front wall 110 of the header connector 100, and a second end 154 spaced apart from the first end 152 and configured for insertion into an opening 32 in printed circuit board 30.

The plurality of shield blades 106 are formed to include a generally right angle shielding portion 128 configured to be inserted into the plurality of second, generally right angle shield-blade-receiving openings 118. The generally right angle shielding portion 128 of each of the plurality of shield blades 106 includes substantially perpendicular first leg portion 130 and second leg portion 132. Each shield blade 106 includes a first end 162 and a second end 164. The generally right angle shielding portion 128 preferably extends to first end 162. When inserted into header body 102, the first end 162 of shield blade 106 extends to the plane of internal surface 122 of the front wall 110 of the header connector 100, adjacent to a signal pin 104, such that first end 162 is substantially coplanar with internal surface 122. First end 162 may be positioned slightly above or below the plane of internal surface 122. The second end 164 of each shield blade 106 is spaced apart from the first end 162 and configured for insertion into a hole 34 in the printed circuit board 30 adjacent to the second end 154 of the signal pin 104. In one embodiment, second ends 164 of shield blades 106 are electrically connected to a ground plane 40 within printed circuit board 30. In a preferred embodiment shield blades 106 are commonly grounded. In an alternate embodiment, shield blades are not commonly grounded. In another alternate embodiment, at least one signal pin 104 is electrically connected with ground plane 40 and commonly grounded with at least shield blade 106 via the ground plane.

As shown in FIG. 3, the first signal-pin-receiving openings 116 and the second shield-blade-receiving openings 118 are arranged symmetrically in the front wall 110 of the header body 102 such that the generally right angle shielding portions 128 of shield blades 106 substantially surround the signal pins 104 to form a coaxial shield around each of the plurality of signal pins 104. Each of the plurality of second, generally right angle shield-blade-receiving openings 118 includes a central portion 134 coupled to first and second end portions 136 and 138 by first and second narrowed throat portions 140 and 142. The first and second narrowed throat portions 140 and 142 are dimensioned to frictionally engage the first and second leg portions 130 and 132 of the shield blades 106 to hold the shield blades 106 in place. The central portion 134 and the first and second end portions 136 and 138 of each of the plurality of second generally right angle openings 118 are formed to provide air gaps 144 surrounding the generally right angle shield portion 128 of a shield blade 106. The geometry and dimensions of the air gaps 144, the geometry, dimensions and material of the right angle shielding portions 128, and the geometry, dimensions and material of the header body 102 surrounding the air gaps 144 are configured to tune the header connector 100 to match a specified impedance (for example, 50 ohms). The configuration of the right angle shield blades 106 lends itself to mass production in a continuous strip in a manner that economizes material usage.

Figure 5:
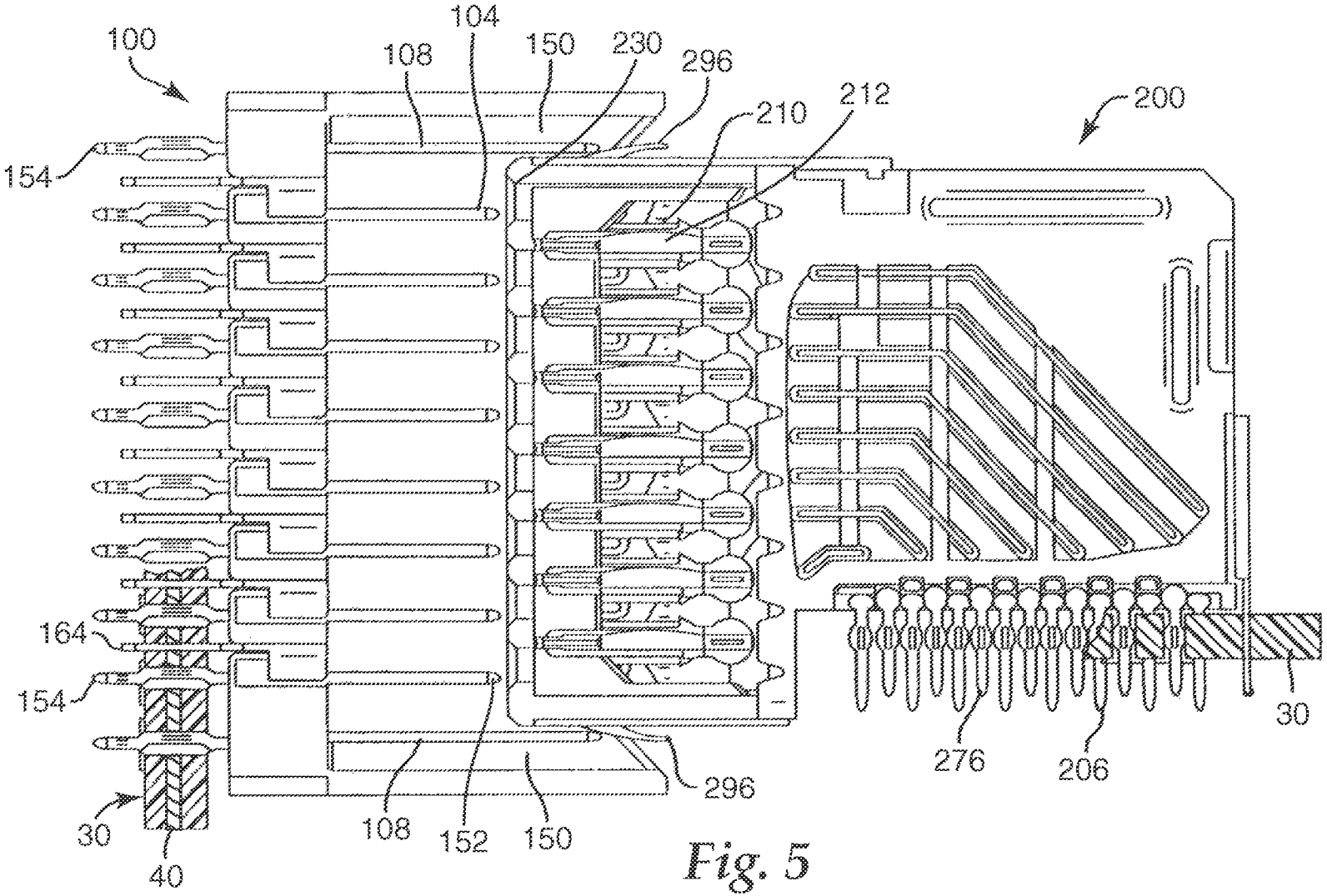
FIG. 5 shows a socket connector partially inserted into a header connector so that the array of pin-insertion windows in the socket connector are aligned with the array of pin contacts in the header connector prior to the reception of the pin contacts in the header connector in the receptacle contacts in the socket connector.

In one embodiment of header 100, a plurality of ground pins 108 are configured for insertion into the plurality of third ground-pin-receiving openings 120 in the front wall 110 of the header connector 100. The plurality of ground pins 108 are configured to engage contact arms 296 of corresponding grounding structures of socket connector 200 when the socket connector 200 is inserted into the header connector 100 as shown in FIG. 5. Each ground pin 108 includes a first end 172 extending above the front wall 110 of the header connector 100, and a second end 174 spaced apart from the first end 172 and configured for insertion into a hole 38 in printed circuit board 30, where electrical contact with ground plane 30 is provided. If socket connector 200 does not include or require a grounding contact, ground pins 108 may be omitted from header 100.

Each of the plurality of signal pins 104 and ground pins 108 includes a pin tail 146, and each strip of shield blades 106 includes at least one shield tail 148. The number of shield tails 148 may be the same as the number of shield blades 106, or may be different than the number of shield blades 106. In a preferred embodiment, each strip of shield blades 106 has a plurality of shield tails 148, with one shield tail 148 for every two shield blades 106, wherein the shield tails 148 are staggered and aligned with alternate shield blades 106 along the strip of shield blades 106. In alternate embodiments, other ratios of shield tails 148 to shield blades 106 may be provided, with the shield tails 148 either uniformly or non-uniformly spaced along the length of the strip of shield blades 106. Embodiments having staggered shield tails 148 on shield blades 106 are particularly useful in back-to-back mounting of header connectors 100 on a printed circuit board, as described with respect to FIG. 7, as the staggered shield tails 148 permit back-to-back mounting of header connectors 100 without interference between shield tails 148 of the opposing header connectors 100. In preferred embodiments, pin tails 146 and shield tails 148 are positioned in an evenly spaced matrix, such that back-to-back mounted header connectors may be mounted orthogonally to each other. When the signal pins 104 and shield blades 106 are inserted into the front wall 110 of the header body 102, the pin tails 146 and the shield tails 148 extend outwardly from the external surface 124 of the front wall 110. The pin tails 146 and shield tails 148 of header 100 can be either press fitted into the holes 32, 34 in the printed circuit board 30 or soldered thereto. Alternatively, the pin tails 146 and shield tails 148 could instead be surface mounted to the printed circuit board 30.

Figure 4:
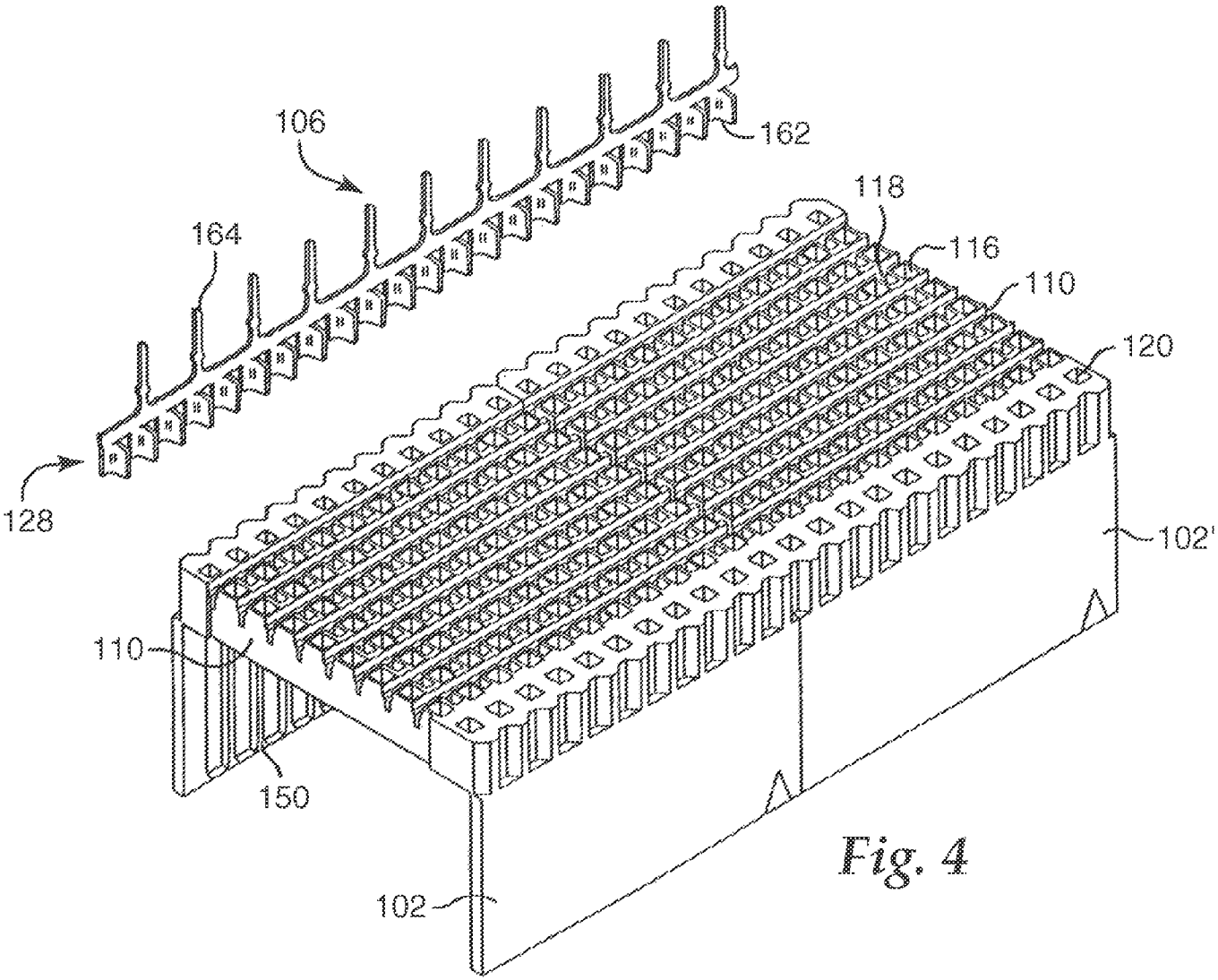
FIG. 4 is a perspective view showing two header bodies positioned end to end, and a strip of shield blades extending across the two header bodies, the strip of the header blades being configured to be inserted into the two header bodies to connect them together to form a monoblock.

FIG. 4 is a perspective view showing first and second header bodies 102, 102' positioned end to end, and one of a plurality of continuous strips of shield blades 106 configured for insertion into a row of shield-blade-receiving openings 118 in the first and second header bodies 102, 102'. The continuous strips of shield blades 106 extend between the first and second header bodies 102, 102' to tie them together to form a monoblock. The continuous strips of shield blades 106 can be used to connect any number of header connectors 100 to create header connectors of variable length. As shown in FIG. 2, the strip of shield blades 106 may be formed to include a right angle tab 106' at opposite ends thereof to provide a secure connection between the header bodies 102.

One embodiment of socket connector 200 is illustrated in FIG. 5, as socket connector 200 is mated with header 100. Socket connector 200 may be any of a variety of connector types, such as a connector configured for connection to a printed circuit board or a cable connector. In one embodiment according to the invention, socket connector 200 is a hard metric connector according to industry standard IEC 61076-4-101. In another embodiment, socket connector 200 is a hard metric connector according to the CompactPCI® or FutureBus® industry standards. In each embodiment, socket connector 200 includes a plurality of signal contacts 210 for making electrical contact with the array of signal pins 104 of the header connector 100, and at least one shielding element 212 associated with the plurality of signal contacts 210. In one embodiment, the at least one shielding element 212 of the socket connector 200 comprises a plurality of strip line shielding elements associated with the plurality of signal contacts 210. When socket connector 200 is configured to mate with a printed circuit board, socket connector 200 may be provided with signal tails 206 and shield tails 276 that can be either press fitted into the holes in the printed circuit boards or soldered thereto. Alternatively, the pin tails 206 and shield tails 276 could instead be surface mounted to the printed circuit boards.

FIG. 5 shows assembly of the header connector 100 with socket connector 200. External guide means such as guide slots 150 or guide pins (not shown) may be provided on the opposite sides of the header connector 100 to guide the insertion of the socket connector 200 into the header connector 100 so that the array of pin-insertion windows 230 in the socket connector 200 are aligned with the array of signal pins 104 in the header connector 100 prior to insertion of the signal pins 104 into mating receptacle contacts 204 of the socket connector 200. As the socket connector 200 is inserted into the header connector 100, signal pins 104 of header 100 make electrical contact with signal contacts 210 of socket connector 200. However, the shield blades 106 of the header connector 100 are too short to contact any shielding elements 212 of the socket connector 200. In one embodiment, the plurality of shield blades 106 of the header connector 100 and the at least one shielding element 212 of the socket connector 200 are unable to make electrical contact when the header connector 100 and the socket connector 200 are in a mated condition. In other embodiments, inadvertent or intermittent contact between shield blades 106 of the header connector 100 and the at least one shielding element 212 of the socket connector 200 is possible, although unnecessary. If provided, the ground pins 108 of the header connector 100 may contact corresponding contact arms 296 or similar structure of socket connector 200.

Figure 6A:
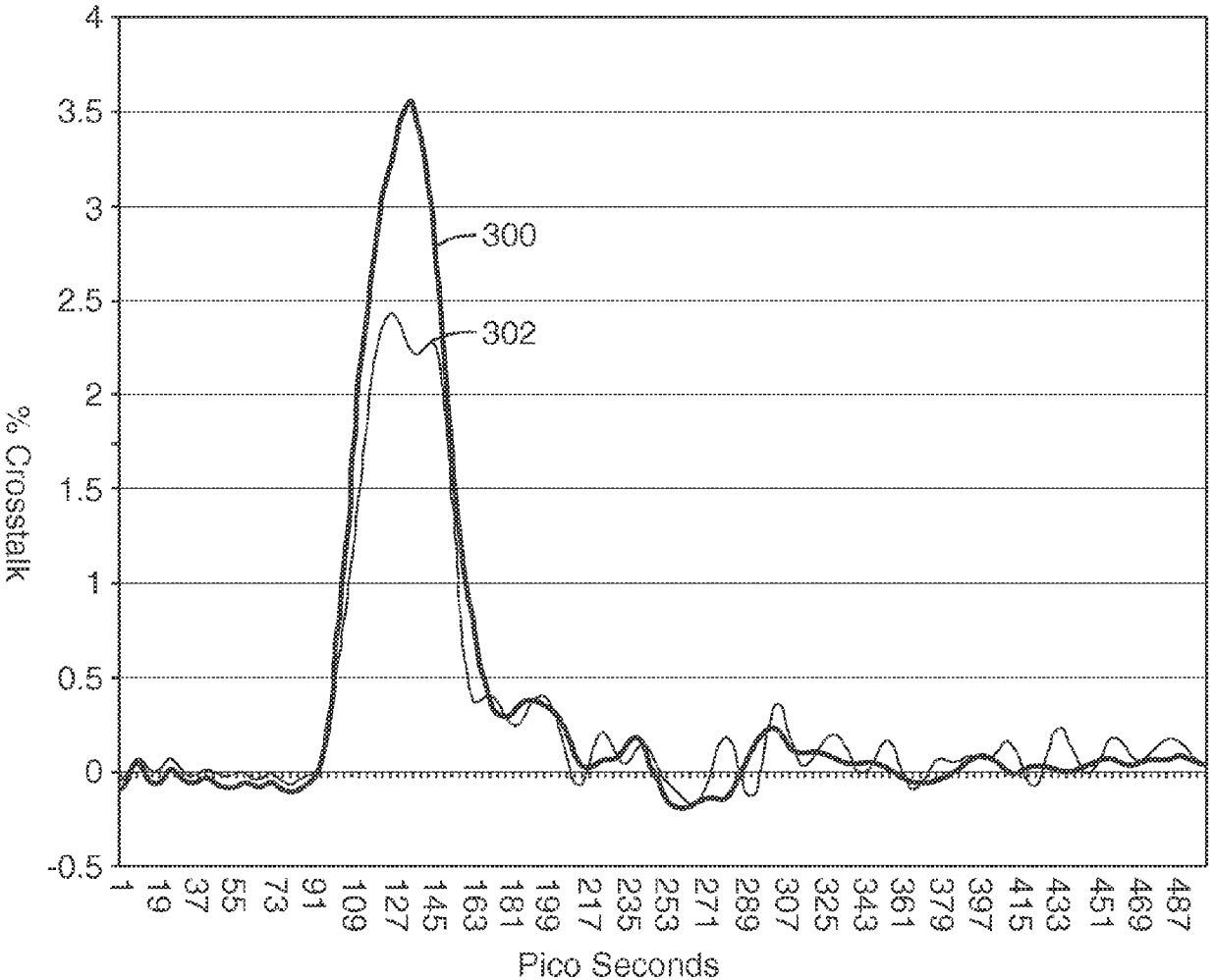
FIGS. 6A and 6B are graphs illustrating the reduction in crosstalk achieved by a header connector in accordance with the invention.
Figure 6B:
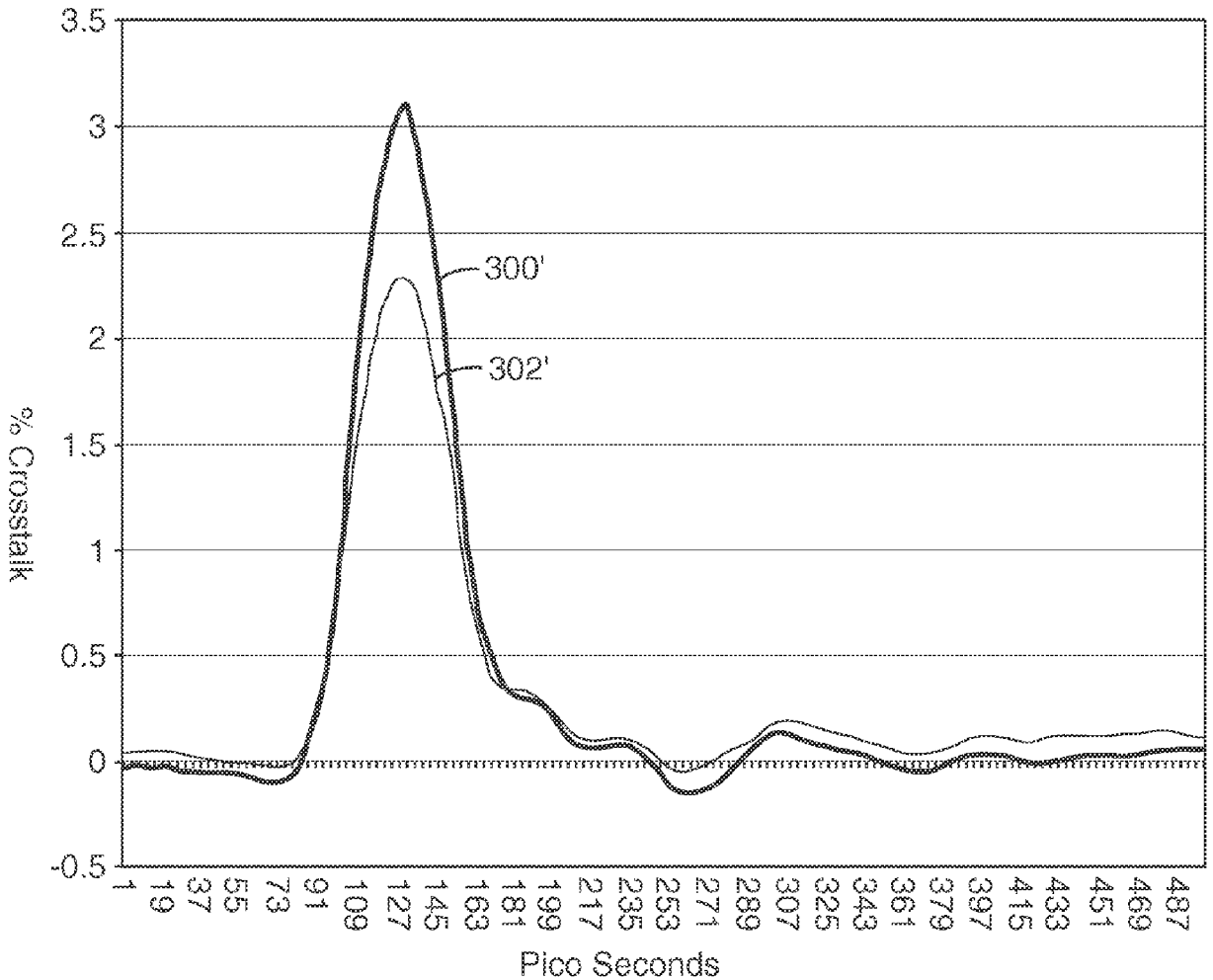

Because shield blades 106 of header connector 100 do not make grounding electrical contact with shielding elements 212 of socket connector 200, one skilled in the art would not expect the provision of shield blades 106 to improve the electrical performance of the interconnect over a header lacking shield blades, and specifically would not expect a decrease in crosstalk. However, as seen in the graphs of FIGS. 6A and 6B, the crosstalk experienced in the interconnection decreases unexpectedly. The graph of FIG. 6A illustrates a signal having a 35 ps rise time, while the graph of FIG. 6*b* illustrates a signal having a 100 ps rise time. In the example of FIG. 6A, the crosstalk decreased from approximately 3.5% for a header lacking shield blades 106 (line 300) to approximately 2.5% for a header provided with shield blades 106 (line 302), providing an improvement of over 28%. In the example of FIG. 6B, the crosstalk decreased from approximately 3.1% for a header lacking shield blades 106 (line 300') to approximately 2.3% for a header provided with shield blades 106 (line 302'), providing an improvement of over 25%.

Figure 7A:
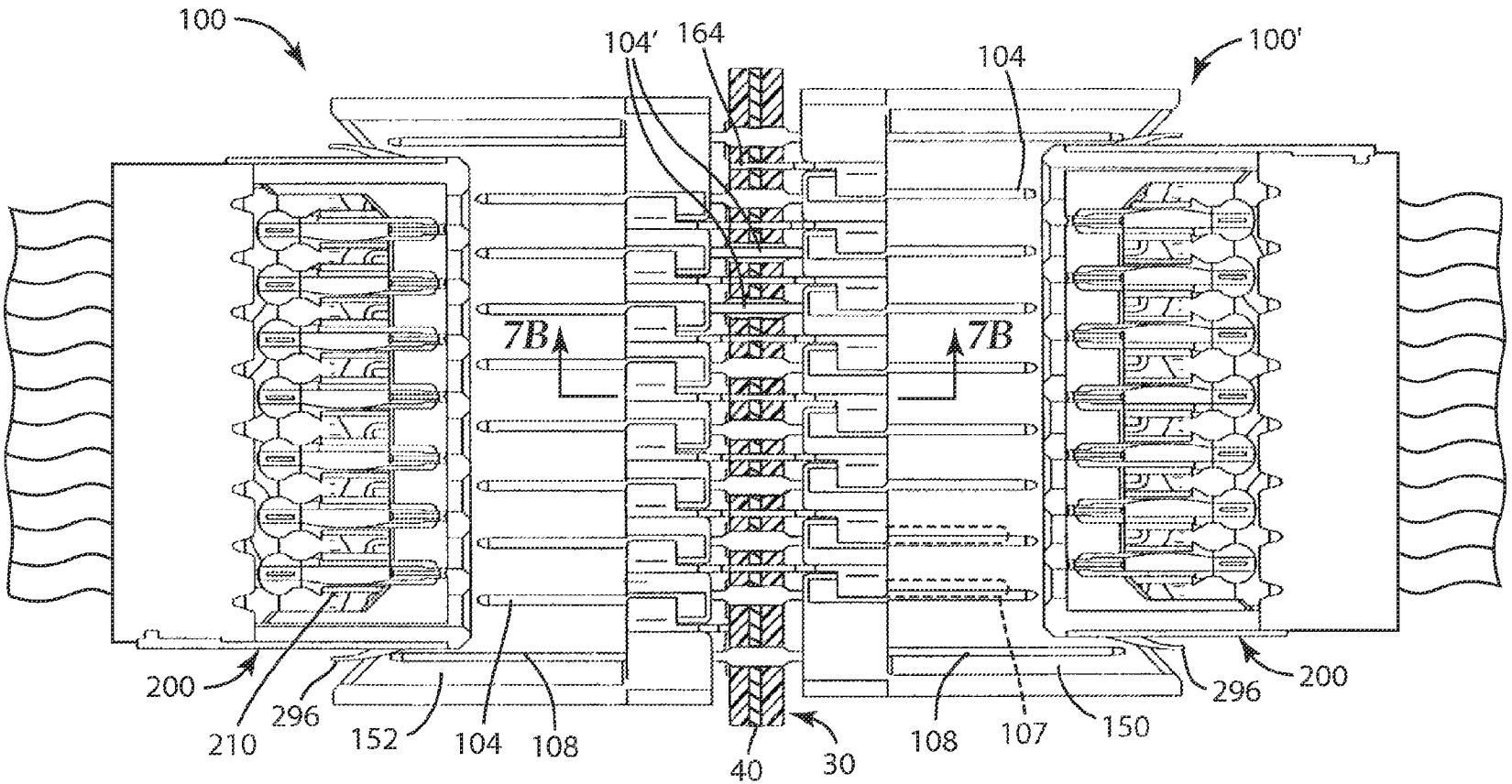
FIG. 7A is a partial cross-sectional view of two header connectors according to the invention positioned on opposite sides of a printed circuit board.
Figure 7B:
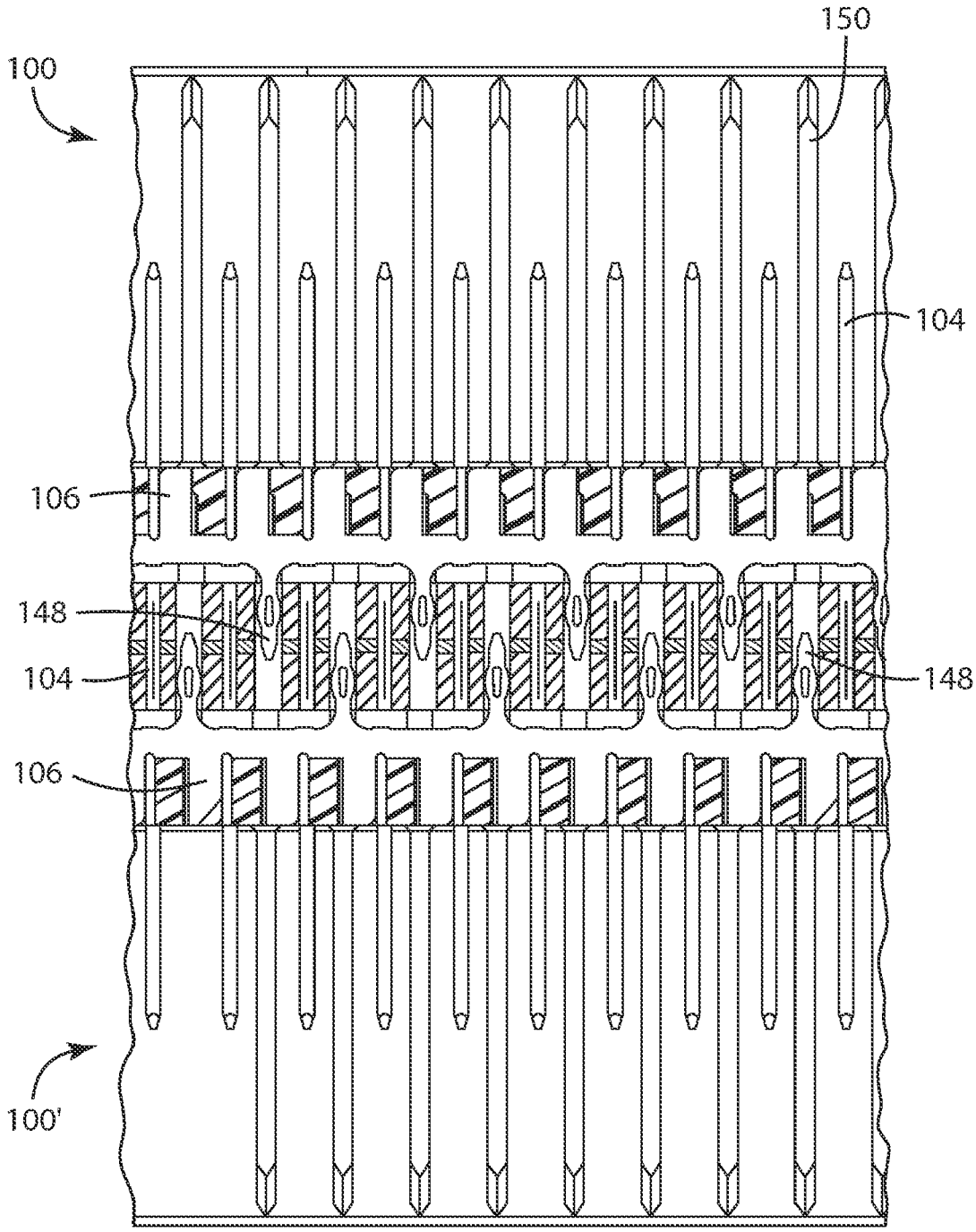
FIG. 7B is a cross-sectional view taken along line 7B-7B in FIG. 7A showing the staggered tails of the shield blades.

Another embodiment of a connector system according to the invention is illustrated in FIGS. 7A and 7B. First and second header connectors 100, 100' are positioned back-to-back on opposite sides of printed circuit board 30. The first and second header connectors 100, 100' are each generally constructed as described above, and each includes header body 102, signal pins 104, shield blades 106, and optional ground pins 108. In an alternate embodiment, shield blades 106 of one header connector 100, 100' may alternately extend above the plane of interior surface 122 for connection to a shielded socket connector, as illustrated by dashed lines 107. In the latter embodiment, the mating socket connector 200 may have relief areas to receive the extended shield blades 107.

The plurality of signal pins 104 and optional ground pins 108 are configured for insertion into the plurality of first signal-pin-receiving openings 116 in the header connectors 100, 100', as described above, except that pins 104, 108 extend continuously through first header connector 100, printed circuit board 30 and second header connector 100' to form an array of signal pins 104 on both sides of printed circuit board 30. In at least one embodiment, at least one signal pin extending through the printed circuit board 30 does not make contact with the printed circuit board, as illustrated by signal pins 104' in FIG. 7A.

The plurality of shield blades 106 of first and second header connectors 100, 100' are formed as described above, with generally right angle shielding portions 128 configured to be inserted into the plurality of second, generally right angle shield-blade-receiving openings 118. The shield tails 148 of each shield blade 106 are configured for insertion into the printed circuit board 30 and are staggered as described above, such that the shield tails of the opposing header connectors 100, 100' do not interfere with each other. In a preferred embodiment, shield tails 148 are positioned in a uniform matrix, such that the longitudinal axes of header connectors 100, 100' may be positioned orthogonal to each other, if desired for a particular application. In one embodiment, shield tails 148 of shield blades 106 of first and second header connectors 100, 100' are electrically connected to ground plane 40 within printed circuit board 30. In a preferred embodiment shield blades 106 are commonly grounded. In an alternate embodiment, shield blades are not commonly grounded. In another alternate embodiment, at least one signal pin 104 is electrically connected with ground plane 40 and commonly grounded with at least shield blade 106 via the ground plane 40.

In addition to the improved electrical performance described above, the header connector 100 described herein provides other advantages, particularly in assembly of the header connector 100 and attachment to a printed circuit board 30. In one embodiment, shield blades 106 and pins 104, 108 may all be inserted into header body 102 prior to attachment to printed circuit board 30. Alternately, shield blades 106 may be first inserted into header body 102, and the header sans pins 104, 108 may be aligned with and secured to printed circuit board 30, via shield tails 148. Openings 116, 120 in header body 102 may then be used as insertion guides and straighteners for pins 104, 108, thereby reducing the probability of stubbing or otherwise damaging pins 104, 108 during assembly. Chamfered entrances for openings 116, 120 may be provided at one or both of internal surface 122 and external surface 124 to assist in the insertion of pins 104, 108. These assembly methods may be combined when mounting header connectors back-to-back on a printed circuit board, as illustrated in FIG. 7. In that instance, a first header connector 100 without pins 104, 108 may be mounted on one side of the printed circuit board 30, and then a second header connector 100 with pins 104, 108 may be installed on the opposing side of the printed circuit board 30. Chamfered entrances for openings 116, 120 at external surface 124 is useful in this assembly method, for capturing pins 104, 108 as they come through circuit board 30. Finally, in each instance, securing header connector 100 to printed circuit board 30 using shield tails 148 provides additional resistance to pull-out forces is provided to header connector 100.

All plastic parts of header connector 100 and socket connector 200 are molded from suitable thermoplastic material, such as liquid crystal polymer ("LCP"), having the desired mechanical and electrical properties for the intended application. The conductive metallic parts are made from, for example, plated copper alloy material, although other suitable materials will be recognized by those skilled in the art. The connector materials, geometry and dimensions are all designed to maintain a specified impedance throughout the part.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the mechanical, electro-mechanical, and electrical arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A connector system for connection to a printed circuit board, the connector system comprising:

a first header body having a front wall formed to include a plurality of first openings and a plurality of second openings therethrough;

a second header body having a front wall formed to include a plurality of first openings and a plurality of second openings therethrough, wherein the first and second header bodies are positioned on opposite sides of a printed circuit board;

a first plurality of shield blades configured for insertion in the plurality of second openings in the first header body;

a second plurality of shield blades configured for insertion in the plurality of second openings in the second header body;

wherein each shield blade of the first plurality of shield blades has a first end that is substantially coplanar with an internal surface of the first front wall;

wherein at least one of the first and second pluralities of shield blades is formed in a continuous strip of material; and wherein the continuous strip of material forming the plurality of shield blades further comprises a plurality of tails configured for engagement with a printed circuit board; and a plurality of signal pins configured for insertion in the plurality of first openings in the first and second header bodies, each of the plurality of signal pins extending continuously through the first openings of the first and second header bodies and the printed circuit board.

2. The connector system of claim 1, wherein each shield blade of the second plurality of shield blades has a first end that is substantially coplanar with an internal surface of the second front wall.

3. The connector system of claim 1, wherein the plurality of tails comprises one tail for every two shield blades.

4. The connector system of claim 1, wherein the plurality of tails are spaced along the continuous strip of material forming the plurality of shield blades.

5. The connector system of claim 1, wherein the plurality of tails are electrically connected to a common ground within the primed circuit board.

6. The connector system of claim 5, wherein at least one of the plurality of signal pins is connected to the common ground within the printed circuit board.

7. The connector system of claim 1, further comprising:

a third header body having a front wall formed to include a plurality of first openings and a plurality of second openings therethrough;

a fourth header body having a front wall formed to include a plurality of first openings and a plurality of second openings therethrough, wherein the third and fourth header bodies are positioned adjacent the first and second header bodies, respectively, on opposite sides of a printed circuit board; and a plurality of signal pins configured for insertion in the plurality of first openings in the third and fourth header bodies, each of the plurality of signal pins extending continuously through the first openings of the third and fourth header bodies and the printed circuit board;

wherein the first plurality of shield blades is configured for insertion in the plurality of second openings in the first and third header bodies, the first plurality of shield blades being formed in a continuous strip of material extending between the first and third header bodies to couple the first and third header bodies together; and wherein the second plurality of shield blades is configured for insertion in the plurality of second openings in the second and fourth header bodies, the second plurality of shield blades being formed in a continuous strip of material extending between the second and fourth header bodies to couple the second and fourth header bodies together.

8. The connector system of claim 1, further comprising:

a socket connector configured to mate with at least one of the first and second header bodies.

9. The connector system of claim 1, wherein at least one of the plurality of signal pins extends through the printed circuit board without making contact with the printed circuit board.

10. The connector system of claim 1, wherein the first and second header bodies each have a longitudinal orientation, and wherein the longitudinal orientation of the first header body is orthogonal to the longitudinal orientation of the second header body.

11. A connector system comprising:

a header connector comprising a front wall having an internal surface, the front wall including a plurality of first openings and a plurality of second openings extending therethrough, a plurality of signal pins inserted in the plurality of first openings to form an array of pin contacts extending above the internal surface of the header body, and a plurality of shield blades inserted in the plurality of second openings, each of the plurality of shield blades having a first end, wherein the first ends of the plurality of shield blades are substantially coplanar with the internal surface of the header body;

wherein the plurality of shield blades is formed in a continuous strip of material;

wherein the continuous strip of material forming the plurality of shield blades further comprises a plurality of tails configured for engagement with a printed circuit board; and a socket connector configured to mate with the header connector;

wherein the socket connector comprises:

a plurality of signal contacts for making electrical contact with the plurality of signal pins of the header connector;

at least one shielding element associated with the plurality of signal contacts; and wherein the plurality of shield blades of the header connector and the at least one shielding element of the socket connector are prevented from making electrical contact when the header connector and the socket connector are in a mated condition.

12. The connector system of claim 11, wherein the at least one shielding element of the socket connector comprises a plurality of strip line shielding elements.

13. The connector system of claim 11, wherein the socket connector is a hard metric connector according to industry standard IEC 61076-4-101.

14. The connector system of claim 13, wherein the socket connector is a CompactPCI® connector.

15. A method of mounting a connector system to a printed circuit board comprising:

attaching a first header connector to a first side of a printed circuit board, the first header connector having a plurality of first openings and a plurality of second openings therethrough, wherein a first plurality of shield blades are inserted in the plurality of second openings in the first header connector; and attaching a second header connector to a second side of the printed circuit board opposite the first header connector, the second header connector having a plurality of first openings and a plurality of second openings therethrough, wherein a second plurality of shield blades are inserted in the plurality of second openings in the second header connector, and wherein a plurality of signal pins are inserted in the plurality of first openings in the second header connector;

wherein each of the plurality of first openings in the first header connector receive a corresponding one of the plurality of signal pins of the second header connector as the second header connector is attached to the printed circuit board;

wherein each shield blade of at least one of the first and second pluralities of shield blades has a first end that is substantially coplanar with an internal surface of the header connector;

wherein at least one of the first and second pluralities of shield blades is formed in a continuous strip of material; and wherein the continuous strip of material forming the plurality of shield blades further comprises a plurality of tails configured for engagement with a printed circuit board.

* * * * *